US007597174B2

(12) United States Patent
Chu

(10) Patent No.: US 7,597,174 B2
(45) Date of Patent: Oct. 6, 2009

(54) ANTI-DEFLECTION STRUCTURE FOR A CHASSIS OF A REMOTE-CONTROLLED CAR

(76) Inventor: Daimler Chu, No. 32, Lane 112, Sihyuan Rd., Sinjhuang City, Taipei County 242 (TW)

( * ) Notice: Subject to any disclaimer, the term of this patent is extended or adjusted under 35 U.S.C. 154(b) by 402 days.

(21) Appl. No.: 11/708,140

(22) Filed: Feb. 20, 2007

(65) Prior Publication Data

US 2008/0011533 A1 Jan. 17, 2008

(30) Foreign Application Priority Data

Feb. 17, 2006 (TW) ..... 95202772 U

(51) Int. Cl.
*A63H 17/26* (2006.01)

(52) U.S. Cl. ..... 180/374; 180/89.1; 180/312; 180/378; 180/375; 180/376; 180/377; 446/88; 446/93; 446/95; 446/424; 446/427; 446/465; 446/466; 446/469; 446/470; 446/471; 280/781

(58) Field of Classification Search ..... 180/89.1, 180/312, 374–379; 280/781; 446/88, 93, 446/95, 424, 427, 443, 465, 466, 469–471
See application file for complete search history.

(56) References Cited

U.S. PATENT DOCUMENTS

| | | | | |
|---|---|---|---|---|
| 6,394,878 | B1 * | 5/2002 | Wang | 446/469 |
| 6,641,457 | B1 * | 11/2003 | Lai | 446/465 |
| 7,317,118 | B2 * | 1/2008 | Lo | 556/466 |
| 2006/0264151 | A1 * | 11/2006 | Byers et al. | 446/469 |

* cited by examiner

*Primary Examiner*—Ruth Ilan
*Assistant Examiner*—James English
(74) *Attorney, Agent, or Firm*—Troxell Law Office PLLC

(57) ABSTRACT

An anti-deflection structure for a chassis of a remote-controlled car includes a board which is added below a central differential gear at a center of a chassis, to strengthen a rigid structure of the chassis. A center of the board is provided with a hollow part for emplacing a gear set of the central differential gear, and an exterior side of the hollow part is provided with a plurality of pivoting holes. The pivoting holes correspond to through-holes on the chassis for locking the central differential gear, thereby locking and fixing the board. In addition, the hollow part is locked at columns of the central differential gear by transfixing screws from bottom to top into the pivoting holes and the through-holes. On the other hand, front and rear ends of the board provide for connection of two support arms, thereby constituting the anti-deflection structure for the chassis.

3 Claims, 5 Drawing Sheets

ANTI-DEFLECTION STRUCTURE FOR A CHASSIS OF A REMOTE-CONTROLLED CAR

BACKGROUND OF THE INVENTION (a) Field of the Invention

The present invention relates to an anti-deflection structure for a chassis of a remote-controlled car, and more particularly to an anti-deflection structure which can increase rigidity of a chassis of a remote-controlled card to achieve an anti-deflection effect, and can be applied to the remote-controlled car or similar structure.

(b) Description of the Prior Art

As a chassis of a remote-controlled car is a rectangular board which is supported on tires by frames at front and rear ends, when the cross-country remote-controlled car jumps and collides heavily, moment of force that a center of the chassis is sustained with will be larger. Referring to FIG. 5, it shows a chassis structure of a conventional remote-controlled car, wherein a center of the chassis 10 is primarily provided with a central differential gear 20 which is locked at columns 21 by transfixing screws from bottom to top into corresponding through-holes 11, and a concaved area 12 and an inspection hole 13 are located between the through-holes 11 to avoid conflict with a gear set 22 of the central differential gear 20.

However, the aforementioned conventional structure will cause flexible bending to the chassis, which will affect operability and velocity of bodywork and weaken a rigid structure at a center of the chassis to result in bending and deformation.

Accordingly, to provide a structure that can strengthen the rigid structure of the chassis, and can be provided with an anti-deflection effect at a same time, is a motive of the present invention.

SUMMARY OF THE INVENTION

The primary object of present invention is to provide an anti-deflection structure for a chassis of a remote-controlled car, such that a rigid structure at the chassis can be strengthened, enabling the chassis to be provided with more strength in resisting with the deflection.

Accordingly, an anti-deflection structure for a chassis of a remote-controlled car of the present invention is primarily constituted by a board and two support arms which are assembled at a center of chassis, wherein a center of the board is provided with a hollow part for emplacing a gear set of a central differential gear, an exterior side of the hollow part is provided with a plurality of pivoting holes corresponding to through-holes on the chassis for locking the central differential gear, and the hollow part is locked at columns of the central differential gear by transfixing screws from bottom to top into the pivoting holes and the through-holes. In addition, front and rear ends of the board are provided with fixing holes for connecting two support arms, and screws are transfixed into the through-holes of chassis and the fixing holes to be locked into corresponding screw-holes at connection parts at bottom ends of the two support arms. On the other hand, the other ends of the support arms are assembled respectively on front and rear frames of bodywork, thereby strengthening a rigid structure of the chassis to achieve the anti-deflection effect.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
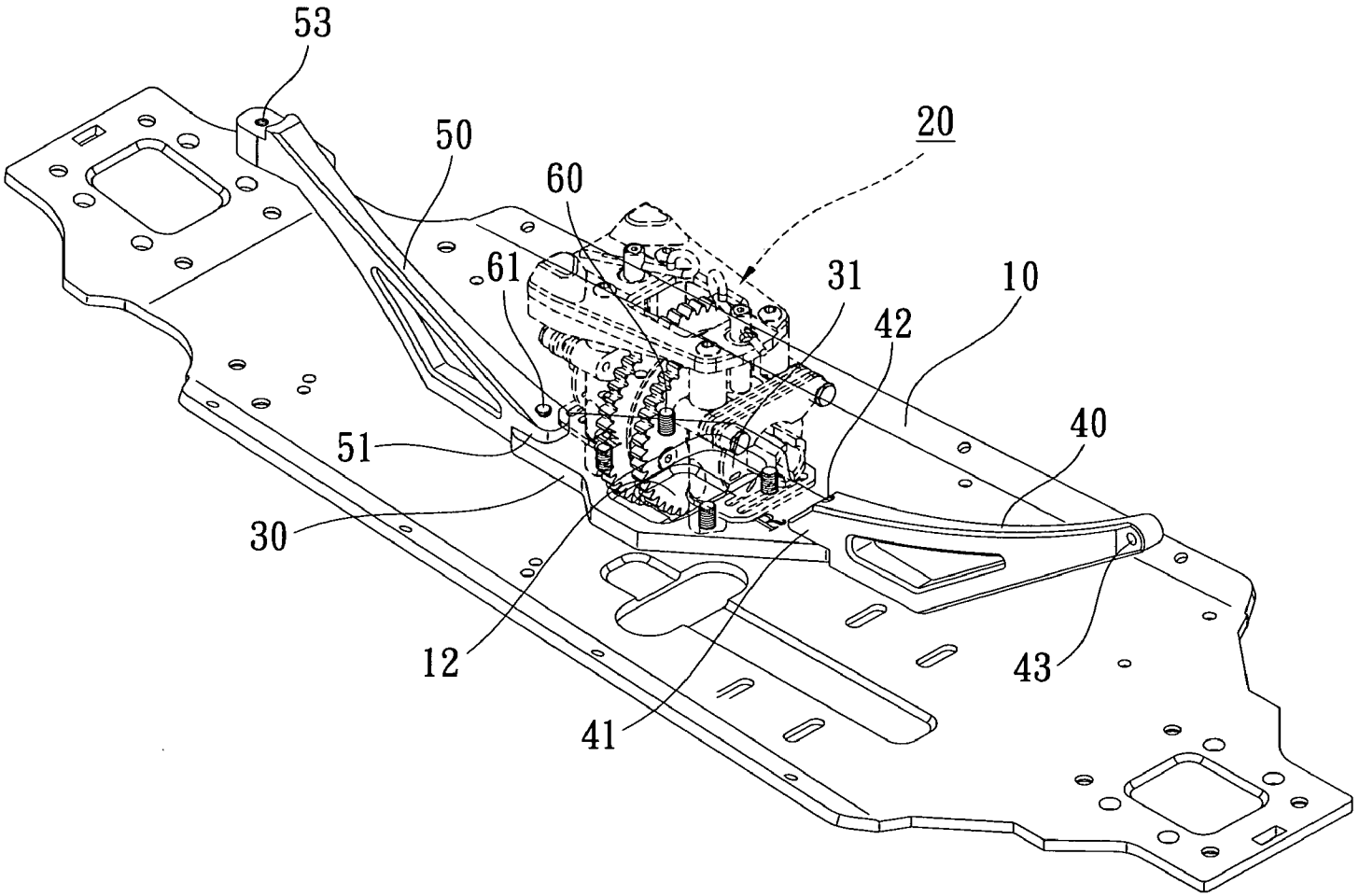
FIG. 1 shows a perspective view of the present invention.
Figure 2:
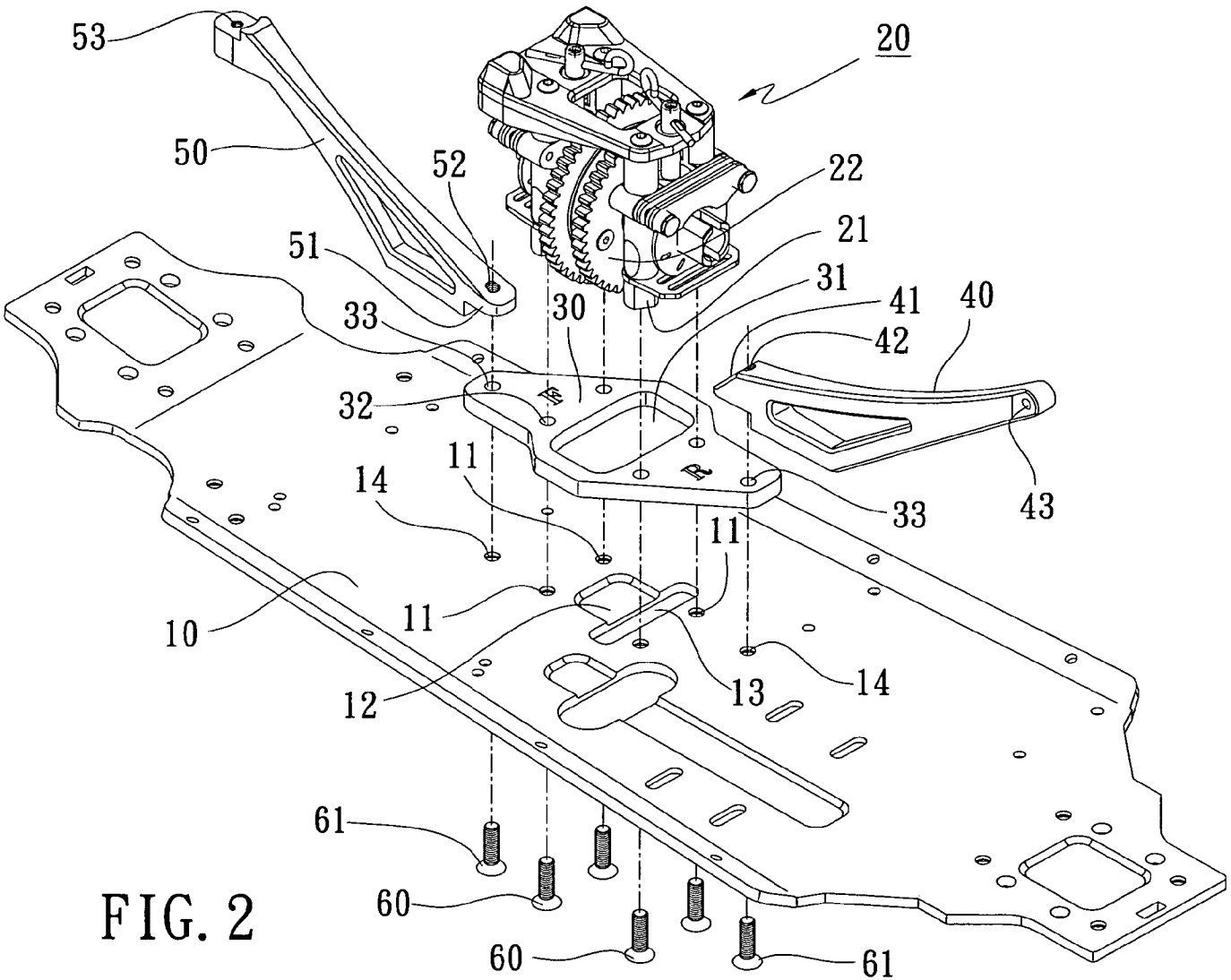
FIG. 2 shows an exploded view of the present invention.
Figure 3:
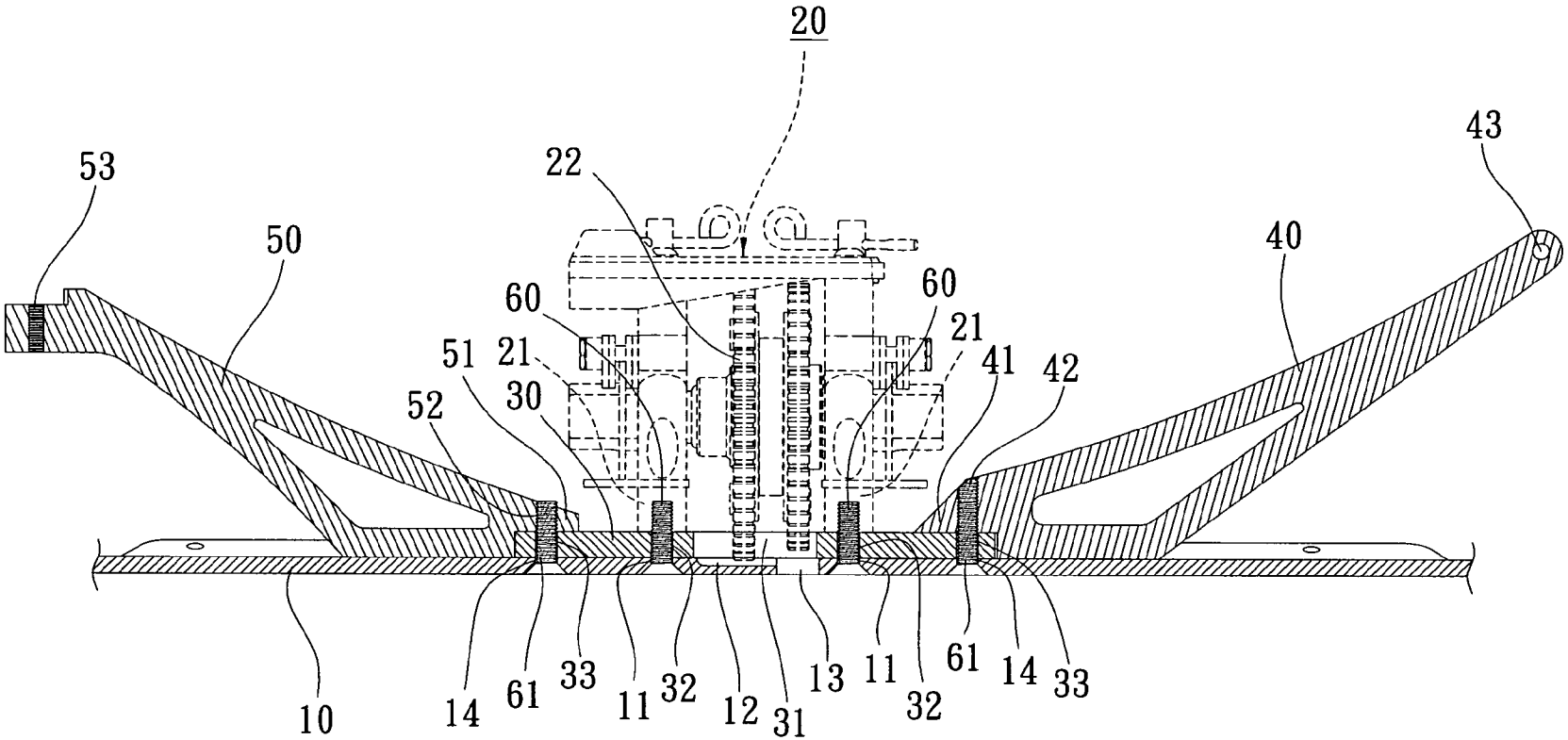
FIG. 3 shows a cutaway view of the present invention after being assembled.

Referring to FIGS. 1 to 3, an anti-deflection structure for a chassis of a remote-controlled car of the present invention comprises primarily a board 30 and two support arms 40, 50 which are assembled between a chassis 10 and a central differential gear 20.

A center of the board 30 is provided with a hollow part 31 for emplacing a gear set 22 of the central differential gear 20, and an exterior side of the hollow part 31 is provided with a plurality of pivoting holes 32 corresponding to through-holes 11 on the chassis 10 for locking the central differential gear 20. In addition, front and rear ends of the board 30 are provided with fixing holes 33 for connecting the two support arms 40, 50.

The two support arms 40, 50 are roughly a long body, and bottom ends of which are provided with connection parts 41, 51. Above the connection parts 41, 51, are provided with screw holes 42, 52 which correspond to the fixing holes 33 of the board 30, and the other ends of the two support arms 40, 50 are provided respectively with locking holes 43, 53.

In assembling, the board 30 is emplaced between the chassis 10 and the central differential gear 20, and is screwed and fixed at columns 21 of the central differential gear 20 by transfixing screws 60 from bottom to top into the through-holes 11 of the chassis 10 and the pivoting holes 32 of the board 30. Next, the connection parts 41, 51 of the two support arms 40, 50 are connected on the fixing holes 33 at the front and rear ends of the board 30. In addition, screws 61 are transfixed into through-holes 14 of the chassis 10 and the fixing holes 33 of the board 30, to be locked into the screw holes 42, 52 of the connection parts 41, 51. On the other hand, the other ends of the two support arms 40, 50 are assembled on front and rear frames of bodywork (not shown in the drawings) through the locking holes 43, 53, thereby accomplishing the assembly of the present invention.

Figure 4:
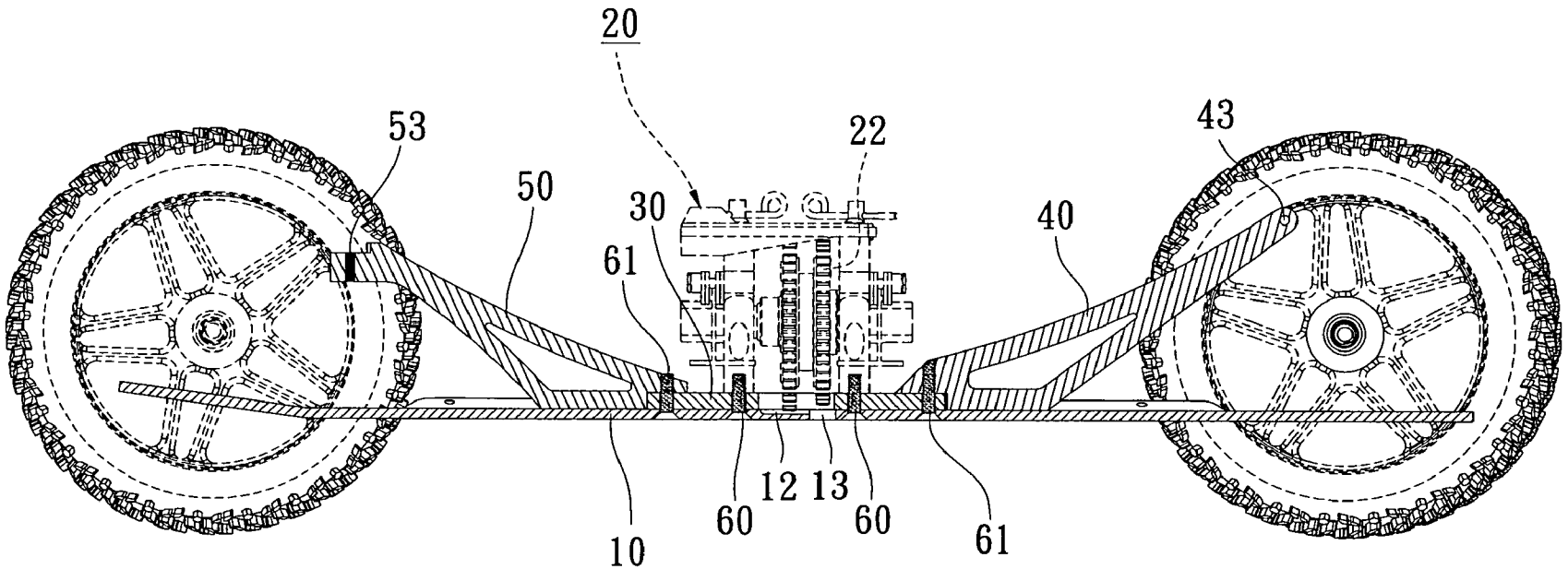
FIG. 4 shows a cutaway view of the present invention being assembled on a chassis.
Figure 5:
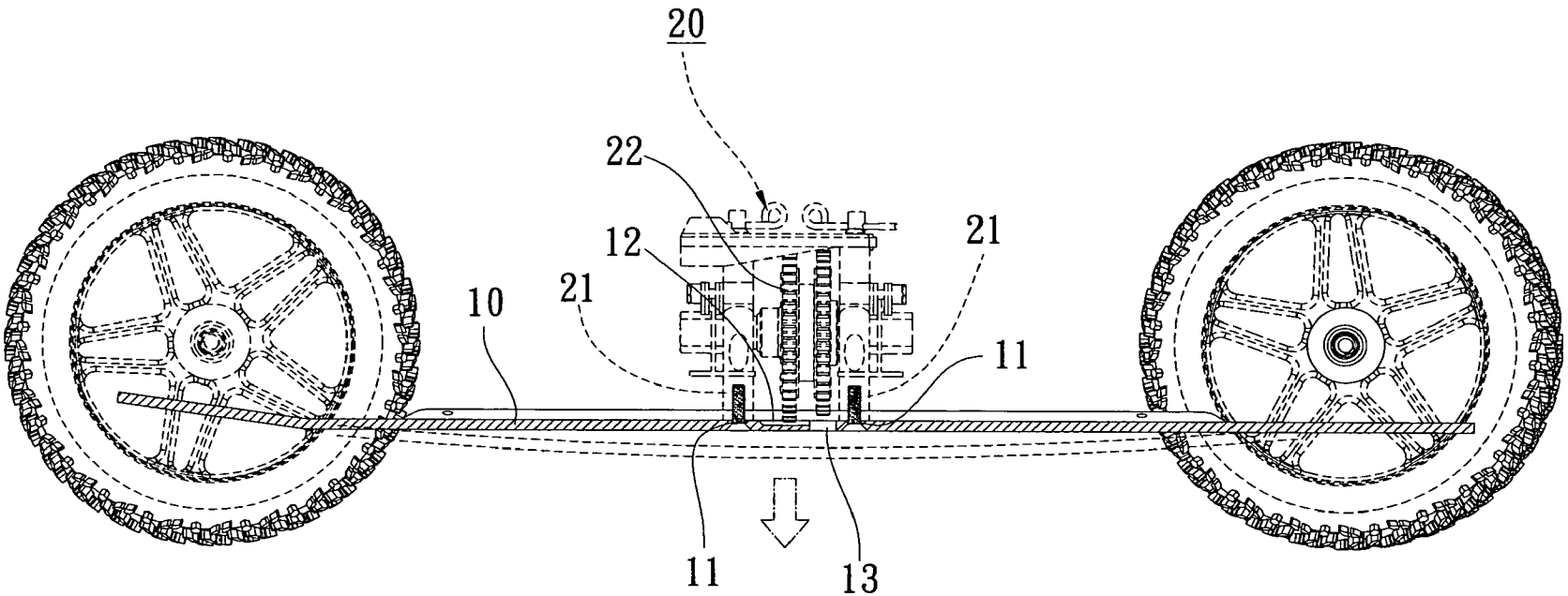
FIG. 5 Prior Art
FIG. 5 shows a cutaway view of a prior art.

Referring to FIG. 4, by the board 30 of the present invention, a rigid structure of the chassis 10 can be strengthened to improve a shortcoming resulted from a concaved area 12 and an inspection hole 13 for avoiding conflict with the gear set 22 of the central differential gear 20 of the conventional chassis 10; and by connecting the two support arms 40, 50 to the front and rear frames of the bodywork, a center of the chassis 10 can be supported, thereby increasing the anti-deflection effect of the chassis 10.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An anti-deflection structure for a chassis of a remote-controlled car comprising a board which is added below a central differential gear at a center of the chassis to strengthen a rigid structure of the chassis; a center of the board being provided with a hollow part for emplacing a gear set of the central differential gear, an exterior side of the hollow part being provided with a plurality of pivoting holes corresponding to through-holes on the chassis for locking the central differential gear, the hollow part being locked at columns of the central differential gear by transfixing screws from bottom to top into the pivoting holes and the through-holes, and front and rear ends of the board providing for connection of two support arms, whereas the other ends of the two support arms being assembled respectively on front and rear frames of bodywork, thereby constituting the anti-deflection structure for the chassis.

2. The anti-deflection structure for a chassis of a remote-controlled car according to claim 1, wherein the front and rear ends of the board are provided with fixing holes for connecting the two support arms.

3. The anti-deflection structure for a chassis of a remote-controlled card according to claim 2, wherein connection ends of the two support arms are provided with connection parts, and above the connection parts are provided with screw-holes; the connection parts being locked at the screw-holes by transfixing screws into the through-holes of the chassis and the fixing holes of the board, and the other ends of the two support arms being provided with locking holes by which the two support arms are assembled at front and rear frames.

* * * * *